US005420669A

United States Patent [19]

Imada

[11] Patent Number: 5,420,669

[45] Date of Patent: May 30, 1995

[54] IMAGE FORMING APPARATUS HAVING PAPER MATCHING CONTROLS

[75] Inventor: Norio Imada, Tokyo, Japan

[73] Assignee: Kabushiki Kaisha Toshiba, Kawasaki, Japan

[21] Appl. No.: 114,051

[22] Filed: Aug. 31, 1993

[30] Foreign Application Priority Data

Aug. 31, 1992 [JP] Japan ..... 4-230623
Aug. 31, 1993 [JP] Japan ..... 5-216342

[51] Int. Cl.[6] ..... G03G 15/00
[52] U.S. Cl. ..... 355/208; 355/311
[58] Field of Search ..... 355/208, 309, 311, 209, 355/308; 271/9, 265, 264

[56] References Cited

U.S. PATENT DOCUMENTS 4,090,787 5/1978 Hubbard et al. ..... 355/314
4,763,889 8/1988 Dei et al. ..... 271/9
5,056,769 10/1991 Ikenoue et al. ..... 271/9
5,168,316 12/1992 Hino et al. ..... 355/309
5,229,814 7/1993 Hube et al. ..... 355/203
5,267,727 12/1993 DeHority ..... 355/311 X
5,287,159 2/1994 Sakakibara ..... 355/311

FOREIGN PATENT DOCUMENTS 59-5489 2/1984 Japan .
0052438 3/1985 Japan .
61-33436 2/1986 Japan .
0108076 4/1990 Japan .
2-187768 7/1990 Japan .
2-309375 12/1990 Japan .
4-19636 1/1992 Japan .
0073781 3/1992 Japan .

*Primary Examiner*—Robert B. Beatty
*Attorney, Agent, or Firm*—Foley & Lardner

[57] ABSTRACT

A calculation unit for comparing specific paper attributes is stored in a nonvolatile memory with the detection results of cassettes. The unit checks whether the specific paper attributes coincide with the detection results, and calculates the weighted points for each matched item. A selection unit compares the calculated values, to select a paper feed cassette most suitable for the specific paper attributes. The results are arranged to numerically evaluate the paper feed cassettes, in this way preferentially selecting the suitable paper feed cassette. Operation keys for setting specific paper attributes are arranged to change specific paper attributes to be preferentially selected. Therefore, in a power-ON or a paper empty state, paper which is required by a user is preferentially selected from a plurality of paper feed means to decrease operations for selecting paper, thus improving operability.

10 Claims, 4 Drawing Sheets

IMAGE FORMING APPARATUS HAVING PAPER MATCHING CONTROLS

BACKGROUND OF THE INVENTION

1. Field of the Invention

The present invention relates to an image forming apparatus having a plurality of paper feed cassettes and, more particularly, to an electrophotographic apparatus, having a plurality of paper feed cassettes, for automatically and preferentially selecting an arbitrary paper feed cassette.

2. Description of the Related Art

Image forming apparatuses having a plurality of paper feed positions for storing a plurality of paper feed cassettes are known. In such a conventional image forming apparatus of this type, in a power-ON or "all clear" operation, a specific paper feed cassette or a paper feed position which is set in the manufacture of the apparatus in advance are automatically selected, regardless of the necessity of a user. That is, conventionally, in a power-ON or "all clear" operation, a specific paper feed cassette automatically selected from the plurality of paper feed cassettes is set in the manufacture of the apparatus in advance.

For this reason, paper sheets in the paper feed cassette automatically selected when a power switch is turned on are not always paper sheets frequently used by a user. In this case, every time the power switch is turned on, or an "all clear" switch is turned on, a required cassette must be reselected by an operator using a console panel, thereby degrading operability. In addition, when the same paper sheets as those in a specific paper feed cassette automatically selected when the power switch is turned on are stored into another paper feed cassette serving as a spare paper feed cassette, and the specific paper feed cassette automatically selected is empty, in a power-ON or the like, the spare paper sheet cassette is not selected, and the specific paper feed cassette containing no paper sheet is selected. For this reason, the operator must manually reselect the spare paper feed cassette containing paper sheets, thereby degrading operability.

In order to solve these problems, a new type of image forming apparatus is disclosed in Jpn. Pat. Appln. KOKAI Publication No. 61-33436. With this apparatus, a user presets the order in which to automatically select the paper feed cassettes when the power switch is turned on or when any one of the cassettes becomes empty. To preset an appropriate order, the user must know what kind of paper sheets are stored in each of the paper feed cassettes. Every time the paper sheets in any paper feed cassette are replaced by those of a different kind, the user must preset a new order in which to select the cassettes automatically.

SUMMARY OF THE INVENTION

It is an object of the present invention to provide an image forming apparatus which has good operability and is capable of reducing the frequency of a paper selecting operation.

It is another object of the present invention to provide an image forming apparatus with good operability, in which a paper feed cassette can be automatically selected to meet an application purpose in consideration of a frequency of use of a user in a power-ON, "all clear" operation, or an empty state in which no sheet is received in the paper feed cassette, thereby decreasing the frequency of a reselecting operation performed every time a power switch is turned on or all of the sheets have been fed from the paper feed cassette.

According to the present invention, there is provided an image forming apparatus comprising: a plurality of sheet storage units for storing sheets, respectively; detecting means, provided for each of the sheet storage units, for detecting a size and a direction of the sheet stored in each of the sheet storage units; means for storing a first value indicating a similarity between the sheet size detected by the detecting means and the sheet size set by the setting means, and a second value indicating a similarity between the sheet direction detected by the detecting means and the sheet direction set by the setting means; means for selecting one of the sheet storage units in accordance with the first value and the second value stored in the storing means; means for supplying the sheet from the storage unit selected by the selecting means; and means for forming an image on the sheet supplied by the supplying means.

According to the present invention, there is also provided an image forming apparatus, comprising: a plurality of sheet storage units for storing sheets, respectively; first storing means for storing a predetermined size of the sheet and a predetermined direction of the sheet; detecting means, provided for each of the sheet storage units, for detecting a size and a direction of the sheet stored in each of the sheet storage units; second storing means for storing a first value indicating a similarity between the sheet size detected by the detecting means and the predetermined sheet size stored in the first storing means, and a second value indicating a similarity between the sheet direction detected by the detecting means and the predetermined sheet direction stored in the first storing means; means for selecting one of the sheet storage units in accordance with the first value and the second value stored in the second storing means; means for supplying the sheet from the storage unit selected by the selecting means, and; means for forming an image on the sheet supplied by the supplying means.

According to the present invention, there is farther provided an image forming apparatus, comprising: a plurality of sheet storage units for storing sheets, respectively; first storing means for storing a predetermined size of the sheet and a predetermined direction of the sheet; detecting means, provided for each of the sheet storage units, for detecting a size and a direction of the sheet stored in each of the sheet storage units; second storing means for storing a first value indicating a similarity between the sheet size detected by the detecting means and the predetermined sheet size stored in the first storing means, and a second value indicating a similarity between the sheet direction detected by the detecting means and the predetermined sheet direction stored in the first storing means; means for reading out the first value from the second storing means, when the size detected by the detecting means corresponds to the predetermined size stored in the first storing means, and reading out the second value from the second storing means, when the direction detected by the detecting means corresponds to the predetermined direction stored in the first storing means; means for generating a third value for each of the sheet storage units by summing the first value and the second value read out by the reading out means; means for selecting one of the sheet storage units according to the third value generated by the generating means; means for supplying the sheet from the storage unit selected by the selecting means, and; means for forming an image on the sheet supplied by the supplying means.

The present invention is arranged as described above, the values of each of the paper feed means are calculated on the basis of the paper state of each of the paper feed means and storage contents of the storage means, and a paper feed means which is frequently used by a user can be automatically selected in accordance with the values of priorities of the paper feed means. For this reason, the frequency of operations for reselecting a paper feed means by an operator in power-ON operation, the empty state in which no paper sheet is received in the paper feed cassette, or the like can be decreased, thereby improving operability.

In addition, since attributes for selecting a paper feed means can be set again by the setting means as needed, a paper feed means more suitable for the request of a user can be preferentially selected, thereby improving operability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described below with reference to FIGS. 1 and 2.

Figure 1:
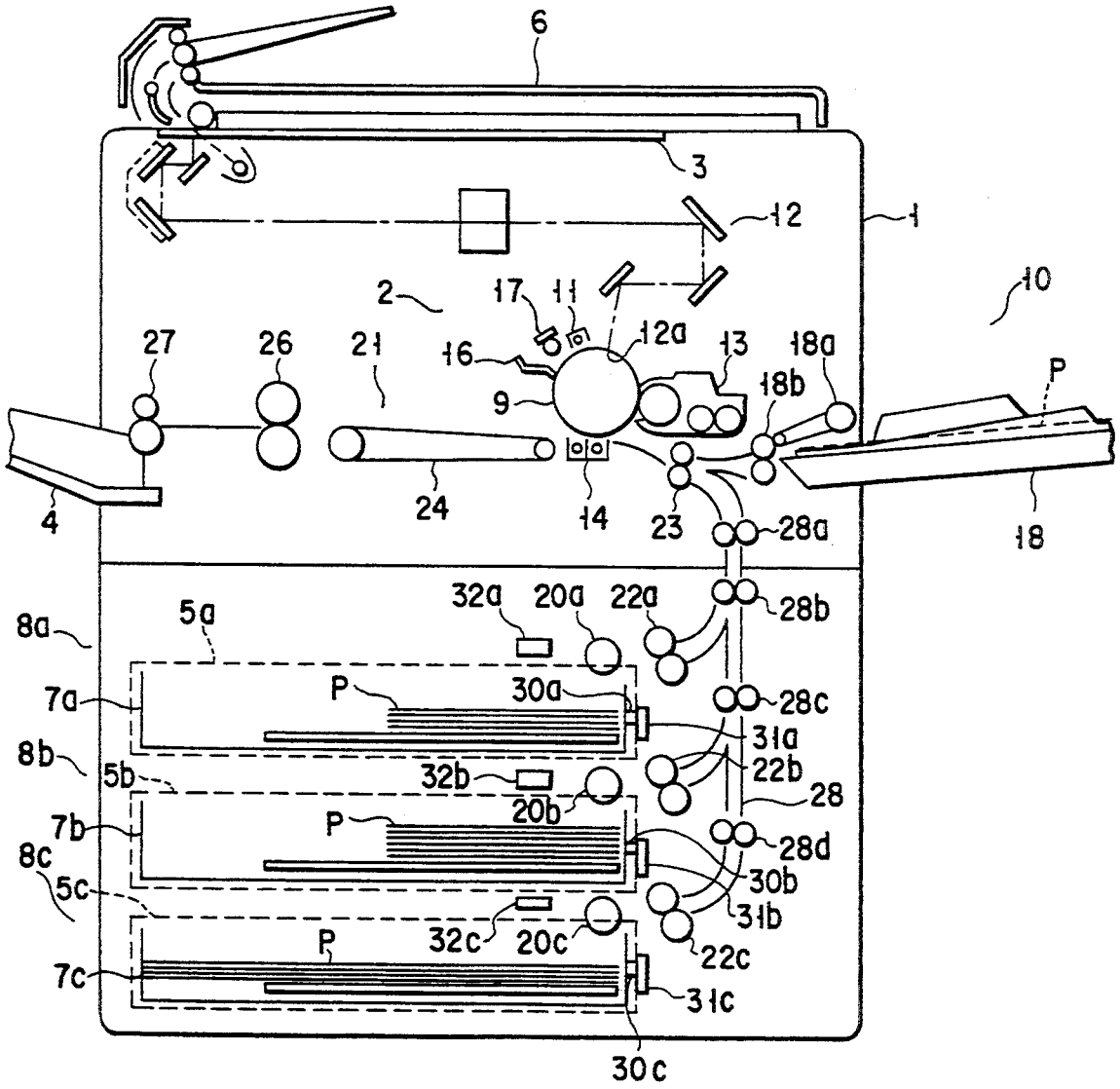
FIG. 1 is a view showing the arrangement of an image forming apparatus according to an embodiment of the present invention.

FIG. 1 shows an image forming apparatus 10. An image forming system 2 for performing charging, exposure, development, transfer, separation, cleaning, discharging, fixing, and the like to form an image is incorporated in an apparatus main body 1, and an original table 3 on which an original is placed is arranged on the upper surface of the apparatus main body 1. An automatic original feeding unit 6 for automatically feeding the original to the original table 3 is arranged on the image forming apparatus 10. First to third paper feed units 8*a* to 8*c* in which first to third paper feed cassettes 7*a* to 7*c* are detachably mounted at first to third paper feed positions 5*a* to 5*c*, respectively, are arranged below the apparatus main body 1 as paper feed mechanisms for feeding paper. The first to third paper feed cassettes 7*a* to 7*c*, as is apparent from FIG. 1, correspond to upper, middle, and lower cassette positions, respectively. In general, paper supply can be more easily performed in the first cassette 7*a* serving as the upper cassette than in the second cassette 7*b* serving as the middle cassette, and paper supply can be more easily performed in the second cassette 7*b* than in the third cassette 7*c* serving as the lower cassette.

First to third detection units 31*a* to 31*c* for detecting the size and storage direction of paper sheets P stored in the first to third paper feed cassettes 7*a* to 7*c* are arranged at the first to third paper feed positions 5*a* to 5*c*, respectively. In order to detect the sizes and storage directions of the paper sheets P, the first to third detection units 31*a* to 31*c* are in contact with first to third switch units 30*a* to 30*c* formed at the distal ends of the first to third paper feed cassettes 7*a* to 7*c*, respectively. The switch units 30*a* to 30*c* have one projection each. The projection can be replaced by another one selected in accordance with the states of the paper sheets P stored in the paper feed cassette, such as the size and the storage direction of the sheets P. The detection units 31*a* and 31*c* are microswitches located in face-to-face relationship with the projections of the switch units 30*a* to 30*c*, respectively. Each detection unit detects the states which the projection of the corresponding switch unit assumes, thereby determining the size, the storage direction, or the like of the paper sheets P stored in the paper feed cassette. First to third empty switches 32*a* to 32*c* for detecting the presence/absence of paper in the paper feed cassettes 7*a* to 7*c* are arranged above the first to third paper feed cassettes 7*a* to 7*c*, respectively.

A photosensitive body 9 serving as a drum-like image carrier on which an optical image is first formed to later form an electrostatic latent image is arranged at an almost central position in the apparatus main body 1, and a charging unit 11 for continuously charging the photosensitive body 9 along the rotational direction thereof, an exposing unit 12 for forming an optical image on an exposed portion 12*a* of the photosensitive body 9, a developing unit 13 for causing a developing agent to develop the electrostatic latent image formed on the photosensitive body 9, a transfer/separation charger 14 for transferring the developed image on a paper sheet and for separating the paper sheet P, to which the image is transferred, from the photosensitive body, a cleaning unit 16 for cleaning the photosensitive body 9, and a discharging unit 17 for discharging the photosensitive body 9 are arranged around the photosensitive body 9, thereby constituting the image forming system 2.

A paper feed tray 18 for manually feeding a paper sheet P to the image forming system 2 is arranged in the right side portion of the apparatus main body 1. In addition, first to third pickup rollers 20*a* to 20*c* for picking paper sheets P from the paper feed cassettes 7*a* to 7*c* of the first to third paper feed units 8*a* to 8*c* are arranged in the apparatus main body 1. A paper convey path 21 along which paper sheets P are conveyed is formed in the apparatus main body 1, paper sheets P picked by the first to third pickup rollers 20*a* to 20*c* along the paper convey path 21 or a paper sheet P fed from the paper feed tray 18 by a manual pickup roller 18*a* and separated by manual separation rollers 18*b* is guided, through the photosensitive body 9, to an exhaust paper tray 4 arranged on the left side of the apparatus main body 1. That is, the paper sheets P in the first to third paper feed cassettes 7*a* to 7*c* are picked up by the first to third pickup rollers 20*a* to 20*c*, respectively. Thereafter, the paper sheets P are separated by first to third separation rollers 22*a* to 22*c*, and are conveyed at predetermined timings by first to fourth convey rollers 28*a* to 28*d* along a guide plate 28 toward the photosensitive body 9. Note that reference numeral 23 denotes resist rollers for aligning the paper sheet P; 24, a conveyor belt for conveying the paper sheet; 26, fixing rollers for fixing an image transferred to each paper sheet P; and 27, an exhaust paper roller pair for exhausting a paper sheet out of the apparatus.

Figure 2:
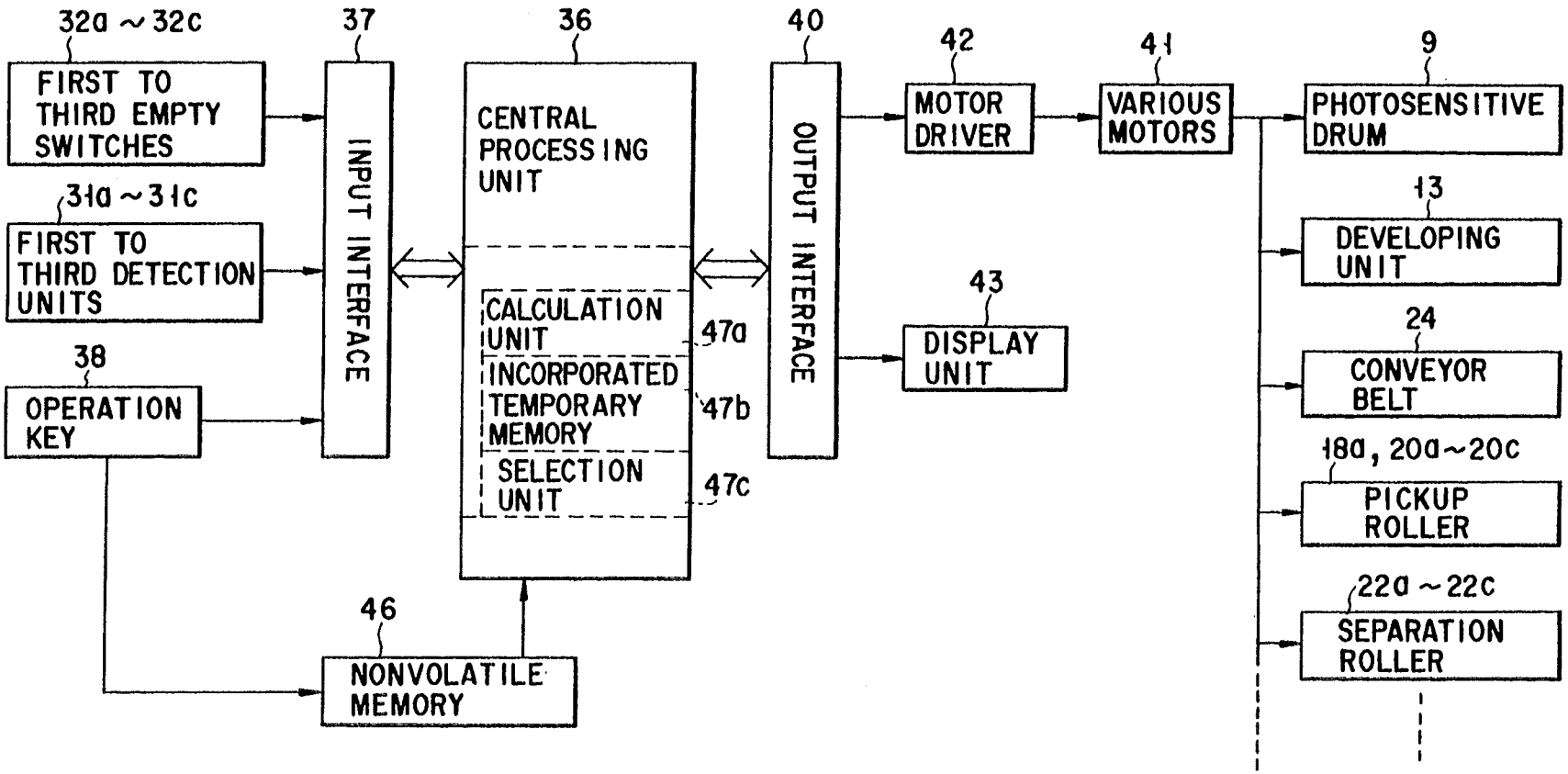
FIG. 2 is a block diagram showing the image forming apparatus according to the embodiment of the present invention.

FIG. 2 is a block diagram showing the circuit of the image forming apparatus 10 shown in FIG. 1. In FIG. 2, reference numeral 36 denotes a central processing unit (CPU) for controlling the image forming system 2 so as to drive the automatic original feed unit 6, the photosensitive body 9, and the developing unit 13 or ON/OFF-control the transfer/separation charger 14, the exposing unit 12 and various motors 41. The CPU 36 is connected to operation keys 38, such as a ten-key pad and a copy key on a console panel (not shown), through an input interface 37, and is connected to the first to third detection units 31*a* to 31*c* and the first to third empty switches 32*a* to 32*c*. The CPU 36 is connected, through an output interface 40, a motor driver 42 for driving the photosensitive body 9, to the developing unit 13, the conveyor belt 24, the pickup rollers 18*a* and 20*a* to 20*c*, the separation rollers 22*a* to 22*c*, and the like and to a display unit 43 on the console panel (not shown).

A nonvolatile memory 46 is connected to the CPU 36. The first memory 46 stores weighted values indicating various directions, such as sizes, storage directions, and presence/absence, of the paper sheets P in the paper feed cassettes 7*a* to 7*c*. The weighted value for the paper size identical to a desired one is "8"; the weighted value for the storage direction identical to a desired one is "4" and the weighted value for the presence of sheets in the cassette is "2." The memory 46 can store those states of the paper sheets P which the user desires most, such as [A-4] size and [landscape] direction. To store desirable states into the memory 46, the user needs only to operate the operation keys 38, using a serviceman code.

The CPU 36 comprises a calculation unit 47*a* for calculating a value representing a priority of each of the paper feed cassettes 7*a* to 7*c*, an incorporated temporary or second memory 47*b* for temporarily storing the value representing a priority and calculated by the calculation unit 47*a*, and a selection unit 47*c* for comparing calculation results stored in the incorporated temporary memory 47*b* to preferentially select any one of the paper feed cassettes 7*a* to 7*c* which has the largest value representing a priority.

In the calculation unit 47*a*, the detection results obtained by the detection units 31*a* to 31*c* and those obtained by the empty switches 32*a* to 32*c* are compared with the states which the user desires most for the paper sheets P in each paper feed cassette and which are stored in the nonvolatile memory 46. When any detection result is identical with the corresponding most desirable state, the value weighted by that most desirable state is read from the nonvolatile memory 46. The weighted values for the various states are added, obtaining a sum for one of the three paper feed cassettes 7*a* to 7*c*. Assuming that the most desirable states are [A-4] size and [landscape] direction, "8", "4", and "2" are added, forming a sum of "14," when the first detection unit 31*a* detects that the sheet P in the first paper feed cassette 7*a* are of A-4 size and in the landscape direction and the first empty switch 32*a* detects that sheets P are stored in the first paper feed cassette 7*a*. Meanwhile, sums are obtained for the other paper feed cassettes. The three sums for the three cassettes 7*a* to 7*c*, which represent the degrees of priority for the paper feed cassette, are stored in temporary memory 47*a*. In accordance with the sums of weighted values, the selection unit 47*c* selects the cassette whose priority is found to be the highest.

As described in the preceding paragraph, the weighted value is "8" for the case where the size of the sheets in any cassette is identical to the desired size stored in the memory 46, is "4" for the case where the storage direction of the sheets in the cassette is identical to the desired direction stored in the memory 46, and is "2" for the case where the empty switch provided for the cassette is off, detecting that the cassette contains paper sheets P. Nonetheless, the manner of weighting the values is not limited to this in the present invention. When the presence or absence of paper sheets in each cassette is the most important factor in selecting one of the cassettes 7*a* to 7*c*, the weighted value is "8" for the case where any cassette contains sheets P, where as the weight value is "4" when the size of the sheets in the cassette is identical to the desired one, and is "4" when the storage direction of the sheets in the cassette is identical to the desired one.

In this manner, values are added to each other for each of the paper feed cassettes 7*a* to 7*c*. The selection unit 47*c* compares the calculation results with each other to select the one of the paper feed cassettes 7*a* to 7*c* which has the largest sum of values. Note that, when calculation results are equal to each other, an upper paper feed cassette is preferentially selected. That is, the paper feed cassettes 7*a* to 7*c* are selected in an order of the upper, middle, and lower cassettes.

An operation of the CPU 36 shown in FIG. 2 will be described below. When the image forming apparatus 10 is delivered and installed for a user, a serviceman stores the specific paper attributes automatically and preferentially selected in an "all clear" operation in the nonvolatile memory 46 through the operation keys 38. That is, the serviceman operates the ten-key pad (not shown) of the operation keys 38 to input, e.g., an [A.4] size and a [landscape] direction, so as to store them in the nonvolatile memory 46.

Thereafter, when a power switch (not shown) for starting a copying operation is turned on, the most desired state for the paper sheets P are input from the nonvolatile memory 46 to the calculation unit 47*a*. The paper sizes and paper directions of paper sheets in the first to third paper feed cassettes 7*a* to 7*c* are input from the first to third detection units 31*a* to 31*c* to the calculation unit 47*a*, and the presence/absence of a paper sheet in each of the first to third paper feed cassettes 7*a* to 7*c* is input from the empty switches 32*a* to 32*c* to the calculation unit 47*a*. That is, for example, paper sheets having an [A.4] size and a [landscape] direction are stored in the first and second paper feed cassettes 7*a* and 7*b*, and paper sheets having an [A.3] size and a [portrait] direction are stored in the third paper feed cassette 7*c*. In this case, these data are input to the calculation unit 47*a*.

Figure 3:
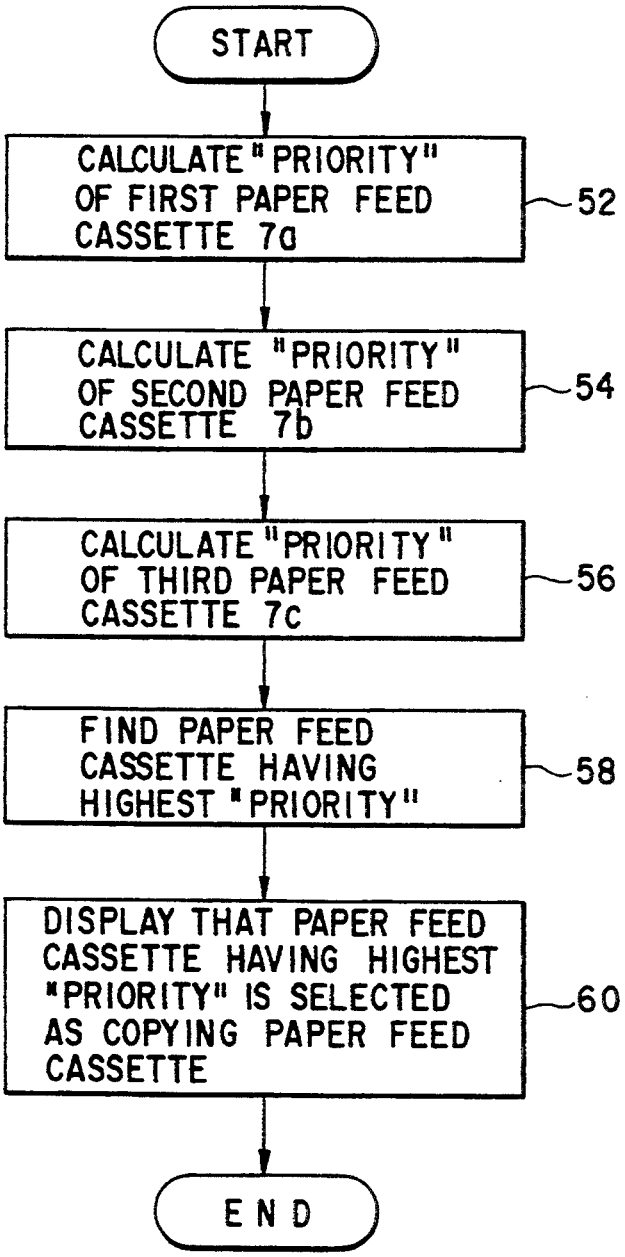
FIG. 3 is a flow chart showing the steps in selecting a paper sheet in the apparatus shown in FIG. 2.

In the calculation unit, as shown in FIG. 3, a priority value of each of the cassettes is calculated. That is, as shown in step 52, the priority value of the first paper feed cassette 7*a* is calculated, as shown in step 54, the priority value of the second paper feed cassette 7*b* is calculated, and as shown in step 56, the priority value of the third paper feed cassette 7*c* is calculated. As shown in step 58, a cassette having the largest priority value is found, and as shown in step 60, a message representing that this cassette is preferentially selected is displayed.

In the above calculation unit 47*a*, the priority values of the cassettes are calculated in the following procedure. In the calculation unit, the most desired state for the paper sheets P from the nonvolatile memory 46 are compared with detection data from the detection units 31*a* to 31*c* to check whether the specific paper states coincide with the detection data. In each of the paper feed cassettes 7*a* to 7*c*, a value of 8 is added when a paper size coincides with the paper size stored in the nonvolatile memory 46, a value of 4 is added when a paper direction coincides with the paper direction stored in the nonvolatile memory 46, or a value of 2 is added when a paper sheet is present. The priority values of the paper feed cassettes 7*a* to 7*c* are numerically evaluated as in the columns of total values of Table 1.

TABLE 1

| | Coincidence between Cassette Paper Size and Stored Paper Size (Weighting Coefficient = 8) | Coincidence between Cassette Paper Direction and Stored Paper Direction (Weighting Coefficient = 4) | Presence of Paper Sheet (Weighting Coefficient = 2) | Total |
|---|---|---|---|---|
| First Paper Feed Cassette (A.4, Landscape) | 8 | 4 | 2 | 14 |
| Second Paper Feed Cassette (A.4, Landscape) | 8 | 4 | 2 | 14 |
| Third Paper Cassette (A.3, Portrait) | 0 | 0 | 2 | 2 |

The calculation values shown in the columns of total values are stored in the incorporated temporary memory 47*b*, and is input to the selection unit 47*c*, so that a paper feed cassette having the largest total coefficient value is automatically selected.

With reference to Table 1, the calculation values of the first and second paper feed cassettes 7*a* and 7*b* are equal to each other, i.e., "14", and it is determined that both the first and second cassettes 7*a* and 7*b* are frequently used and are to be preferentially selected. In this case, the selection unit 47*c* automatically selects the first paper feed cassette which is located at a upper position, and a message representing that the first paper feed cassette 7*a* is selected is displayed on the display unit 43. This is because the first paper feed cassette 7*a* corresponds to the upper cassette, and paper supply can easily be performed in an upper cassette. The position each cassette assumes may be used as a factor for calculating the priority of the cassette. In this case, it suffices to use "3", "2" and "1" as weighting coefficients for the first cassette 7*a* from which sheets P can be fed most easily, for the second cassette 7*b* from which sheets P can be fed less easily, and for the third cassette 7*c* from which sheets P can be fed least easily, respectively. These weighting coefficients are stored also in the nonvolatile memory 46.

Figure 4:
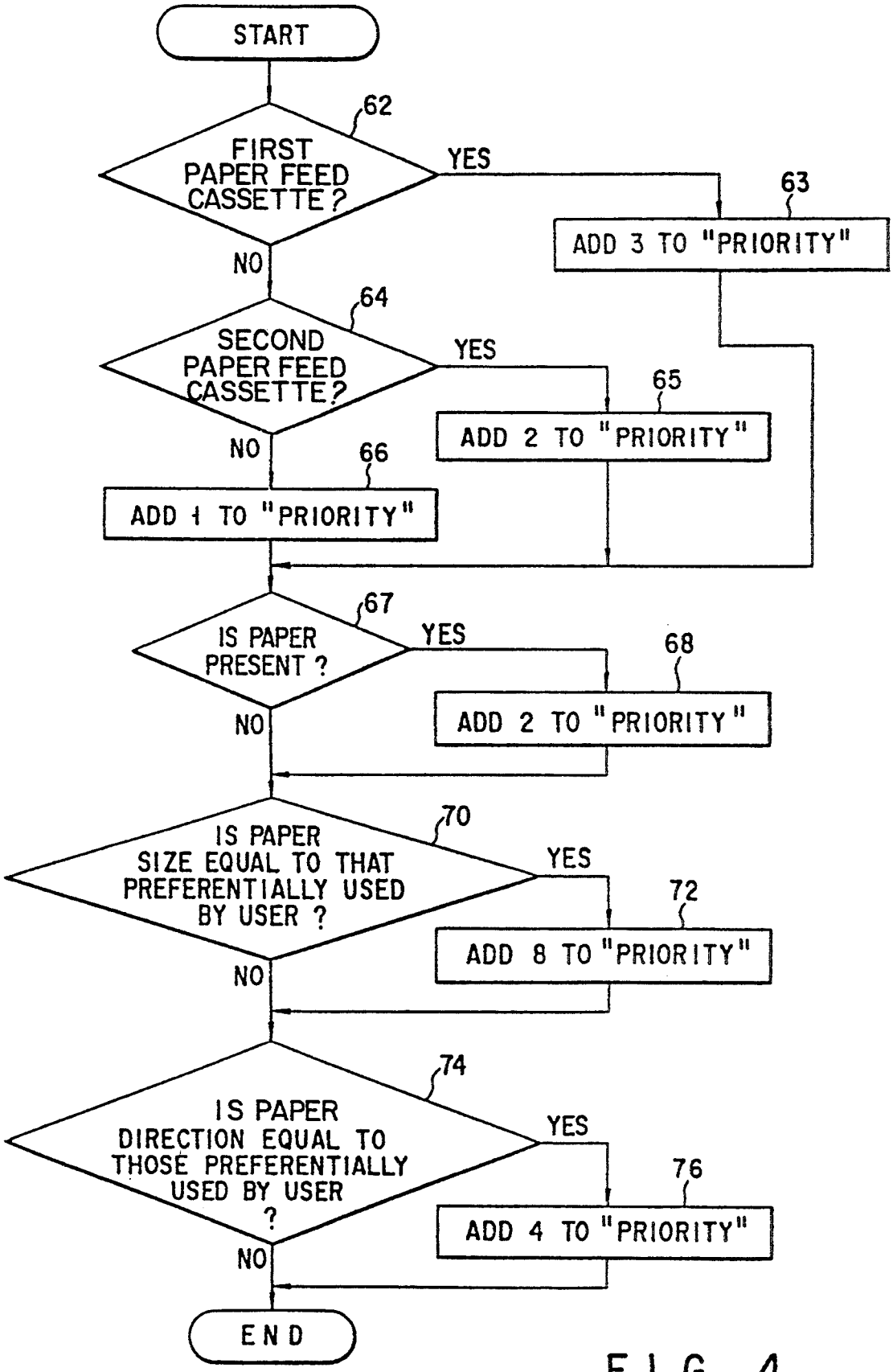
FIG. 4 is a flow chart showing the calculation of priorities shown in FIG. 3.

A procedure of calculating priority values in consideration of paper supply will be described below with reference to FIG. 4. In step 62, it is determined whether or not priority needs to be calculated for the first cassette 7*a*. If Yes, "3" is added as a priority coefficient for the first cassette 7*a* in step 63. If No, the flow goes to step 64, in which it is determined whether or not priority needs to be calculated for the second cassette 7*b*. If Yes in step 64, "2" is added as a priority coefficient for the second cassette 7*a* in step 65. If No, the flow goes to step 66, in which "1" is added as a priority coefficient for the third cassette 7*c*.

As shown in step 67, it is checked whether paper is present in the cassette 7*n*. when the paper is present, a coefficient of 2 is added to the priority coefficient of the cassette 7*n* as shown in step 68. It is checked whether a paper size which is stored in the nonvolatile memory 46 and is to be preferentially used by a user coincides with the paper size stored in the cassette 7*n*. When the paper sizes coincide with each other, a coefficient of 8 is added to the priority coefficient of the cassette 7*n*, as shown in step 72. In addition, it is checked, as shown in step 74, whether a paper direction which is stored in the nonvolatile memory 46 and is to be preferentially used by the user coincide with the direction the paper stored in the cassette 7*n*. When the stored paper direction and size coincide with the cassette paper direction and size, a value of 4 is added to the priority coefficient of the paper feed cassette 7*n*, as shown in step 76. In this manner, the priority coefficient of the paper feed cassette 7*n* is calculated.

Assuming again that the most desirable states are [A-4] size and [landscape] direction, the values shown in the following Table 2 will be used as weighting coefficients for the paper feed cassettes 7*a*, 7*b*, and 7*c*, if A4-size sheets are stored in landscape direction in the first cassette 7*a*, A4-size sheets are stored in landscape direction in the second cassette 7*b*, and A3-size sheets are stored in portrait direction in the third cassette 7*c*.

TABLE 2

| Cassette | Cassette position | Size identical | Direction identical | Sheets stored | Sum |
|---|---|---|---|---|---|
| 7a (A4, landscape) | 3 | 8 | 4 | 2 | 17 |
| 7b (A4, landscape) | 2 | 8 | 4 | 2 | 16 |
| 7c, A3, portrait | 1 | 0 | 0 | 2 | 3 |

In this case, the selection unit 47*c* automatically selects the first paper feed cassette 7*a*. The paper sheets P will then be fed from the cassette 7*a* one by one to the copying section.

As described above, when the power switch is turned on, the first paper feed cassette 7*a* in which paper sheets P which have an [A.4] size and a [landscape] direction, are frequently used by a user, and desired to be preferentially selected is automatically selected. For this reason, in a copying operation to be performed later, the selected paper need not be often changed. Therefore, when preferentially selected paper satisfies paper conditions of the copying operation, an operator sets other copying conditions without selecting another paper feed cassette, and the operator depresses a copy key (not shown) to start a copying operation.

When the copying operation is started, in the apparatus main body 1, while the photosensitive body 9 is rotated, a toner image is formed on the photosensitive body 9 through the charging unit 11, the exposing unit 12, and the developing unit 13. During rotation of the photosensitive body 9, in the transfer/separation charger 14, the toner image is transferred to a paper sheet P fed from the first paper feed cassette *7a*. Thereafter, the photosensitive body 9 passes by the cleaning unit 16 and the discharging unit 17 so as to complete the copying operation, and a next copying operation can be performed.

On the other hand, the paper sheet P passes through the fixing rollers 26 and the exhaust paper roller pair 27 and is exhausted to the exhaust paper tray 4, and the copying operation is repeated to obtain a required number of copies. Thereafter, when a copying operation must be performed with a paper sheet having a size different from the above size, a required paper feed cassette is reselected with the operation keys 38, or the first paper feed cassette *7a* is replaced with a paper feed cassette in which paper having the required size is stored so as to select the paper having the proper size, and a copying operation is performed in the same manner as described above.

When the "all clear" key (not shown) of the operation keys 38 is turned on to perform a new copying operation, a magnification is set to be 1, the number of copies is set to be [1], and the procedure of calculating priority value is executed so that a paper sheet cassette having a high priority coefficient is selected.

Suppose that the first cassette *7a* becomes empty while the sheets P fed from it are still undergoing copying operation. In this case, the values used as weighting coefficients for the cassettes *7a, 7b,* and *7c* will changed to the ones shown in the following Table 3:

TABLE 3

| Cassette | Cassette position | Size identical | Direction identical | Sheets stored | Sum |
|---|---|---|---|---|---|
| 7a (A4, landscape) | 3 | 8 | 4 | 0 | 15 |
| 7b (A4, landscape | 2 | 8 | 4 | 2 | 16 |
| 7c, A3, portrait | 1 | 0 | 0 | 2 | 3 |

In this instance, the sum of weighted values for the second cassette *7b* is the greatest. Hence, the selection unit 47*c* automatically selects the second paper feed cassette *7b,* and the copying operation is resumed. Assuming that the second cassette *7b* becomes empty, too, the sum of weighted values for the first cassette *7a* and that for the third cassette *7c* will remain at "15" and "3," respectively, and that for the second cassette *7b* will decrease to "14." The sum for the first cassette *7a* becomes the greatest. However, the first cassette *7a* stores no paper sheets P at this time. The copying operation is not, thereby, resumed, the message "EMPTY" is displayed, and the copying operation is stopped.

In brief, the priority of each paper feed cassette is calculated even if the selected cassette become empty during the copying operation, just as at the time of turning on the power supply switch, and the copying operation is automatically stopped when the cassette having the highest priority becomes empty.

While the image forming apparatus 10 is used as described above, assume that the type of paper sheets which are frequently used by a user is changed, and that another type of paper sheets must be preferentially selected. In this case, new preferential conditions are set with the operation keys 38.

When these conditions are set, the user can clearly check with reference to the number of points whether a specific paper feed cassette of the first to third paper feed cassettes *7a* to *7c* satisfies the specific paper conditions to be preferentially selected. Therefore, when the power switch is turned on, the "all clear" key is depressed or no paper sheet is stored in the cassette, the paper sheet cassette in which the paper desired by user is stored can easily be automatically selected in accordance with the number of points.

In addition, the most desired state for the paper sheet cassette P stored in the nonvolatile memory 46 can be properly set again with the operation keys 38, and a paper sheet to be preferentially selected can be changed in accordance with needs of the user. For this reason, when the power switch is turned on, when the "all clear" key is depressed or when no paper sheet stored in the cassette, a paper sheet which is optimal in practical use can be selected, and the number of selecting operations of a paper feed cassette performed by an operator can be decreased, thereby improving operability.

In the above embodiment, a priority value is calculated on the basis of the factors such as the presence/absence of paper sheets, a paper size, a paper direction and the position of the paper feed cassette. However, the priority value may be calculated in consideration of the number of paper sheets left in a cassette, a copying speed, i.e., an image formation speed per paper sheet, whether a speciality paper sheet, i.e., a paper sheet having another quality, is stored in a cassette. When the apparatus has no means for detecting the quality on the like of a paper sheet, data related to the speciality paper sheet is stored in the nonvolatile memory 46 with the operation keys 38, the number of points related to the priority of the speciality paper sheet is added to a priority value on the basis of the data.

The present invention is not limited to the above embodiment. Various changes and modifications can be effected without departing from the spirit and scope of the invention. For example, items representing specific paper states and weighting coefficients of each item can be arbitrarily set, the number of paper feed means mounted in the main body is not limited to a specific value, and any paper feed means can be optionally added. Therefore, a large number of paper feed means in which the same paper sheets frequently used are stored are arranged, and the paper feed means are sequentially and preferentially selected every time one of the paper feed means becomes empty. In this manner, the number of stored paper sheets can be substantially increased, so that the function can be expanded.

Paper sheets which are frequently used are not preferentially selected by numerically evaluating the paper feed cassettes, and a paper feed position to be preferentially used may be selected by numerically evaluating paper feed positions at which the paper feed cassettes are detachably mounted. In this case, as items of the specific paper states stored in the storage means, in place of a paper size and a paper direction, an item representing a paper feed position number and an item representing whether a paper feed cassette is mounted, are used.

The present invention is applied not only to a case a paper sheet is preferentially selected when the power switch is turned on, but also to a case when a paper sheet used at the start of a normal copying operation after the power switch is turned on is automatically selected.

That is, in this case, the size of an original is read by an original detecting unit, and the read result is used as a specific paper state for preferentially selecting a paper feed means or a state which the user desires most for the paper sheet in each paper feed cassette. In a calculation unit, the specific paper state is compared with the detection result of a paper sheet stored in a paper feed cassette. When the specific paper state coincides with the detection result, a weighted value is added to each of the items representing the specific paper states to numerically evaluate each of the paper feed means, the total numbers of points awarded to the paper feed means are compared with each other, and a paper feed means in which optimal paper sheets are stored is selected.

As described above, according to the present invention, the paper feed means are numerically evaluated to check whether the paper feed means satisfies specific paper states to be preferentially selected, when the power switch is turned on or when no paper sheet is stored in a cassette. For this reason, it can be clearly determined and selected whether any one of the plurality of paper feed means is a paper feed means for paper feeding desired by the user.

In addition, when items of specific paper states for preferentially selecting a paper feed means are changed, or weighting coefficients are changed, references used for preferentially selecting the paper feed means can also be variably changed.

The specific paper attributes can be set again as needed, a paper sheet suitable for the request of a user or the like can be preferentially selected. For this reason, an operation of reselecting a paper feed means after a paper feed means is preferentially selected is reduced, thereby improving operability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

a plurality of sheet storage units for storing sheets, respectively;

first storing means for storing a predetermined size of the sheets and a predetermined direction of the sheets;

a detecting means for each of the sheet storage units, for detecting the size, the direction, and the presence or absence of sheets stored in each of the sheet storage units;

second storing means for storing a first value indicating the degree of similarity between the sheet size detected by the detecting means and the predetermined sheet size stored in the first storing means, a second value indicating the degree of similarity between the sheet direction detected by the detecting means and the predetermined sheet direction stored in the first storing means, and a third value indicating the presence or absence of sheets in each of the sheet storage units;

means for selecting one of the sheet storage units in accordance with the first, second and third values stored in the second storing means;

means for supplying sheets from the storage unit selected by the selecting means if the selected unit contains sheets and stopping the sheet feeding operation if the selected storage unit contains no sheets, and;

means for forming images on the sheets supplied by the supplying means.

2. An image forming apparatus according to claim 1, wherein the first value is set to be greater than the second value, when the size of the sheets is more important than the direction of the sheets.

3. An image forming apparatus according to claim 1, wherein the second value is set to be greater than the first value, when the direction of the sheets is more important than the size of the sheets.

4. An image forming apparatus comprising:

a plurality of sheet storage units for storing sheets, respectively;

first storing means for storing a predetermined size of the sheets and a predetermined direction of the sheets;

detecting means, provided for each of the sheet storage units, for detecting a size, a direction and the presence or absence of sheets stored in each of the sheet storage units;

second storing means for storing a first value indicating the degree of similarity between the sheet size detected by the detecting means and the predetermined sheet size stored in the first storing means, a second value indicating the degree of similarity between the sheet direction detected by the detecting means and the predetermined sheet direction stored in the first storing means and a third value indicating the presence or absence of sheets;

means for reading out the first value from the second storing means when the sheet size detected by the detecting means corresponds to the predetermined sheet size stored in the first storing means, reading out the second value from the second storing means when the direction detected by the detecting means corresponds to the predetermined direction stored in the first storing means and reading out the third value when presence of sheets is detected;

means for generating a fourth value for each of the sheet storage units by summing the first value, the second value, and the third value read out by the reading out means;

means for selecting one of the sheet storage units according to the fourth value generated by the generating means;

means for supplying sheets from the storage unit selected by the selecting means if sheets are present in the selected sheet storage unit and stopping the sheet feeding operation if no sheets are present in the selected sheet storage unit, and;

means for forming images on the sheets supplied by the supplying means.

5. An image forming apparatus according to claim 4, wherein the first value is set to be greater than the second value, when the size of the sheets is more important than the direction of the sheets.

6. An image forming apparatus according to claim 4, wherein the second value is set to be greater than the first value, when the direction of the sheets is more important than the size of the sheets.

7. An image forming apparatus according to claim 4, wherein the selecting means selects the supplying means in accordance with the order of the fourth values from greater to lesser.

8. An image forming apparatus comprising:

a plurality of sheet storage units for storing sheets, respectively;

detection means, provided for the respective sheet storage units, for detecting the sizes and directions of the sheets stored in each of the sheet storage units and the presence or absence of the sheets in each of the sheet storage units;

first setting means for setting a desired sheet size and a desired sheet direction;

means for storing first values indicating the degrees of similarity of the sizes of the sheets which are detected by the detecting means relative to the desired sheet size set by the setting means, second values indicating the degrees of similarity of the directions of the sheets which are detected by the detecting means relative to the desired sheet direction set by the first setting means,and third values indicating the presence or absence of said sheets in each of the sheet storage units;

means for determining priority levels of the sheet storage units on the basis of fourth values, the determining means reading out the first values, the second values and the third values from the storing means, and calculating the fourth values from the first, second and third values;

means for selecting one of the sheet storage units on the basis of the priority levels of the sheet storage units which are determined by the determining means;

means for supplying the sheets from the storage unit selected by the selecting means;

means for forming an image on the sheets supplied by the supplying means;

second setting means for setting a number of times the image forming means is to perform an image forming operation; and means for controlling the determining means, the supplying means and the image forming means, such that when said one of the sheet storage units which is selected by the selecting means is emptied before image forming operations corresponding to the number of times set by the second setting means are completed, the determining means again performs a priority level determining operation; and when a sheet or sheets are stored in the one of the sheet storage units which has the highest priority level, the sheet or sheets stored in said one of the sheet storage units which has the highest priority level are supplied by the supplying means, and the image forming operation continues to be performed, and when no sheets are stored in said one of the sheet storage units which has the highest priority level, the image forming operation is terminated.

9. An image forming apparatus according to claim 8, wherein the first value is set to be greater than the second value, when the size of the sheets is more important than the direction of the sheets.

10. An image forming apparatus according to claim 8, wherein the second value is set to be greater than the first value, when the direction of the sheets is more important than the size of the sheets.

* * * * *